United States Patent [19]

Eaton

[11] 4,078,411

[45] Mar. 14, 1978

[54] FLOATING CLAMP DIE

[75] Inventor: Homer L. Eaton, Leucadia, Calif.

[73] Assignee: Eaton-Leonard Corporation, Santa Ana, Calif.

[21] Appl. No.: 741,689

[22] Filed: Nov. 15, 1976

[51] Int. Cl.[2] ..... B21D 7/04

[52] U.S. Cl. ..... 72/154; 72/155; 72/159

[58] Field of Search ..... 72/149, 150, 151, 154–159, 72/310, 311, 318, 369, 321

[56] References Cited

U.S. PATENT DOCUMENTS

| | | | |
|---|---|---|---|
| 2,810,422 | 10/1957 | Bower | 72/154 |
| 2,871,909 | 2/1959 | Bower | 72/321 |
| 2,880,780 | 4/1959 | Mackey | 72/151 |
| 2,924,261 | 2/1960 | Fredericks | 72/21 |
| 2,974,706 | 3/1961 | DeWitt | 72/150 |
| 2,988,127 | 6/1961 | Gray | 72/21 |
| 3,155,139 | 11/1964 | Hautau | 72/150 |
| 3,261,193 | 7/1966 | VanHarten | 72/150 |
| 3,584,492 | 6/1971 | Dodge et al. | 72/154 |

FOREIGN PATENT DOCUMENTS

| | | | |
|---|---|---|---|
| 546,757 | 10/1957 | Canada | 74/154 |
| 1,257,524 | 2/1961 | France | 72/149 |
| 1,072,454 | 12/1959 | Germany | 72/388 |
| 1,112,381 | 8/1961 | Germany | 72/159 |
| 175,070 | 4/1961 | Sweden | 72/149 |

*Primary Examiner*—E. M. Combs
*Attorney, Agent, or Firm*—Gausewitz, Carr & Rothenberg

[57] ABSTRACT

A clamp die for urging a tube against a rotatable bend die is mounted for limited translational and rotational motion so that its tube receiving cavity will accommodate and receive a portion of a bend previously made in the tube. Thus, one bend may be started closely adjacent a previous bend and little or no length of the straight and as yet unbent tube need extend forwardly of the point of tangency with the bend die in order to permit gripping by the floating clamp die.

5 Claims, 18 Drawing Figures

FIG. 1.
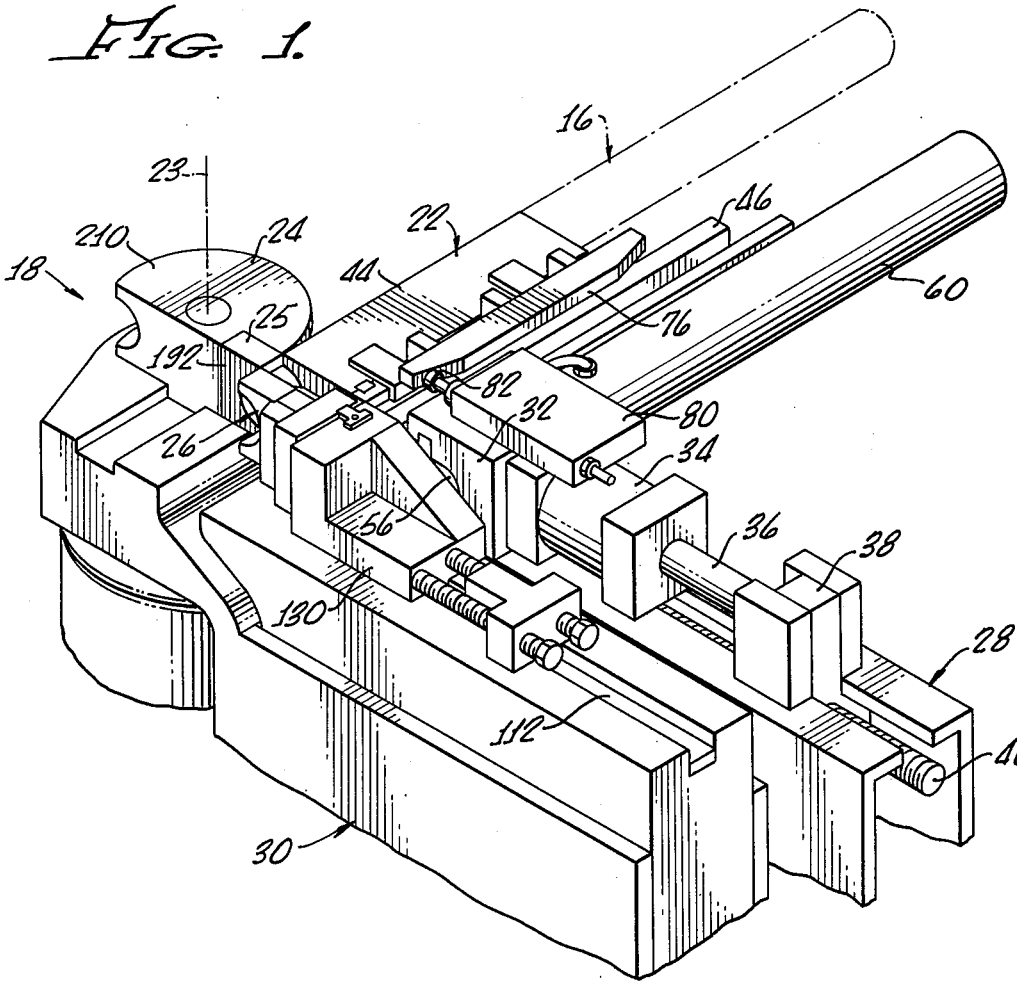
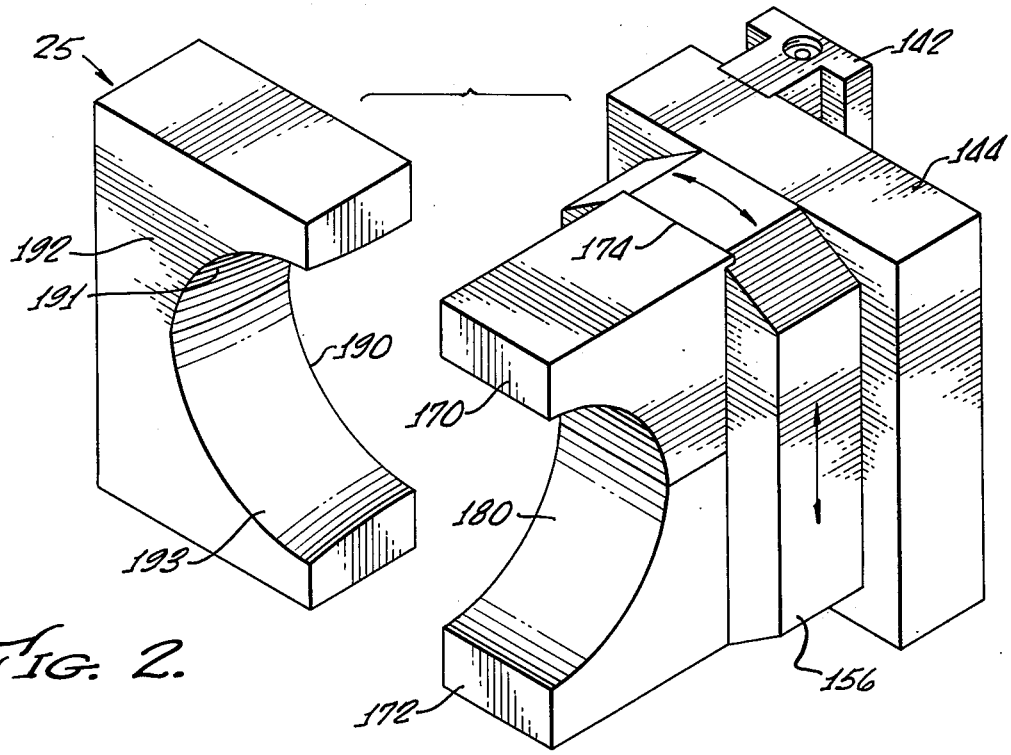
FIG. 2.

FIG. 15.
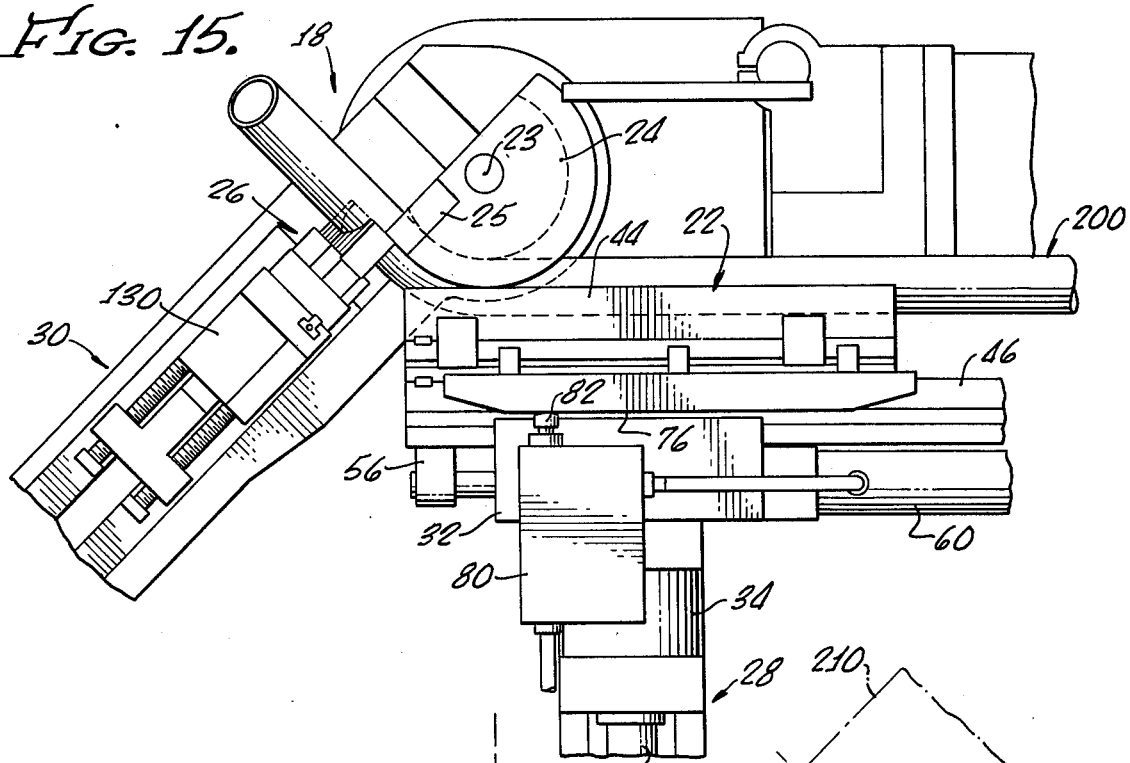
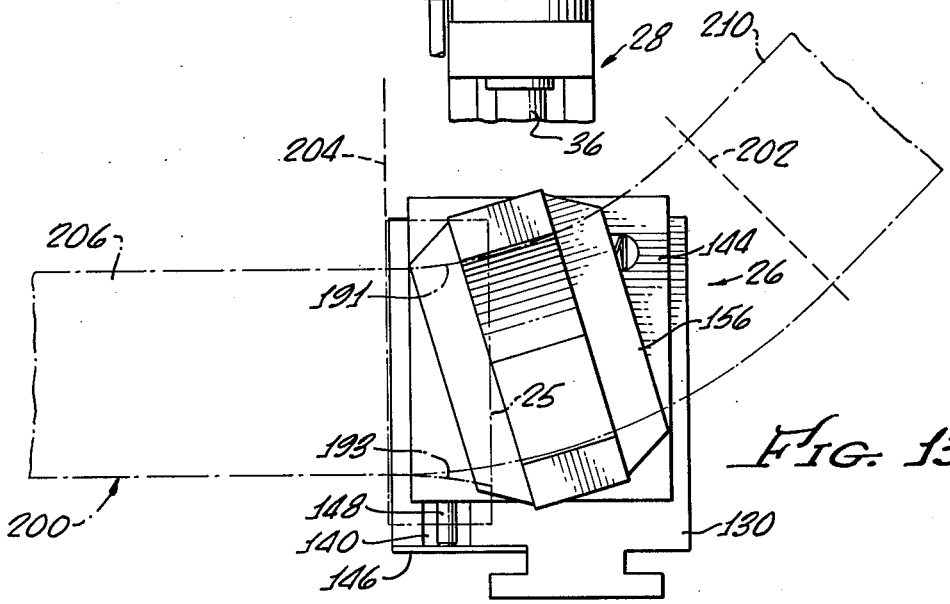
FIG. 13.
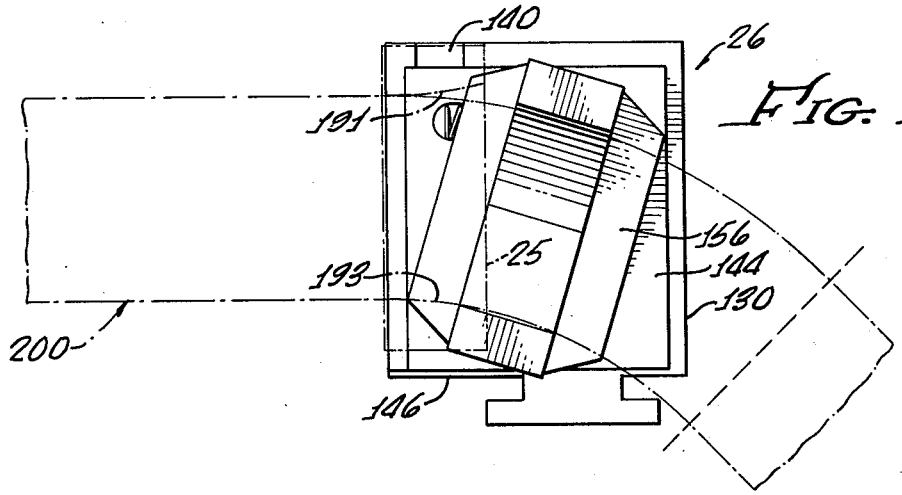
FIG. 14.

FLOATING CLAMP DIE

This invention is an improvement on and particularly adapted for use with the inventions of my prior co-pending applications, both entitled Method and Apparatus for Bending Tube, Ser. No. 614,946, filed Sept. 19, 1975, now abandoned, and Ser. No. 692,585, filed June 3, 1976, the latter being a continuation-in-part of the former. The disclosures of such co-pending applications are incorporated by reference as though fully set forth herein.

BACKGROUND OF THE INVENTION

The present invention relates to apparatus for bending tubes and more particularly concerns an apparatus having an improved clamp die arrangement.

A common form of bending tubes, employing either compression or draw bending, involves clamping of a forward section of a tube to a rotary bend die by a clamp die and clamping a rearward section of the tube against the bend die by a pressure die. The bend and clamp dies are rotated together, with the tube clamped therebetween, to bend the tube around the bend die. In compression bending, little or no axial restraint is applied to the tube, which thus moves axially as the bend die rotates. In draw bending, sufficient axial restraint is applied to the tube to stretch the tube beyond its elastic limit as it bends around the bend die, thus minimizing wrinkling or buckling of tube material on the inside of the bend. A combination of compression and draw bending is described in my co-pending applications identified above.

As described in such co-pending applications, draw bending requires a sufficient axial restraint to be exerted upon the tube by a pressure die so that the material of the tube can be stressed past its yield point. This is achieved by exerting sufficient pressure on the tube by the pressure die and, concomittantly, by the clamp die, which presses a forward portion of the tube against the bend die. In order to achieve adequate pressure on the tube (between the clamp and bend die) for draw bending, the clamp die must press against the tube over a significant length of the tube. Commonly the clamp die has a length, parallel to the extent of the tube, in the order of three times the tube diameter. If the clamp die is much shorter than this, the tube is likely to slip relative to the clamp die or, in the alternative, such great force must be exerted by the clamp die upon the tube that the tube is often unacceptably deformed. Because large clamp dies have been required for draw bending, it has not been possible in this type of bending to form tube bends close together. Two successive bends cannot be any closer to each other than the length of the clamp die since the latter, in prior machines, must operate upon a straight and as yet unbent portion of the tube.

In my prior applications above identified, a method of bending is described in which the required length of the clamp die is greatly minimized by starting a bend as a compression bend, without axial restraint, and then, after the tube has been partly bent around the bend die, employing the frictional forces between the bent tube and the bend die to augment the clamping force of a short clamp die and to enable it to exert the axial restraint required for the subsequent draw bending which completes the bend.

However, even with the greatly shortened clamp die of my prior invention, the die is capable of operation only upon a section of the tube that is straight and as yet unbent. Thus, a portion of the tube to the rear of a prior bend must be provided for cooperation with the clamp die and such tube portion must be straight and unbent for at least the length of the clamp die. In my prior invention, even though the required length of the clamp die is considerably decreased, one bend still cannot be made any closer to a succeeding bend than the length of this shortened clamp die. Stated otherwise, there must be provided (in prior arrangements) a straight tube portion between two successive bends, which straight portion has a length equal to that of the clamp die.

Accordingly, it is an object of the present invention to provide a bending machine in which the length of a required straight portion of tube between successive bends is minimized.

SUMMARY OF THE INVENTION

In carrying out principles of the present invention, in accordance with a preferred embodiment thereof, a tube bending machine is improved by employing means for movably mounting the clamp die so as to enable it to receive a portion of the tube that extends forwardly of the bend die at an angle with respect to the longitudinal extent of the tube to be bent. More specifically, the clamp die is mounted for limited translational and pivotal motion so as to enable it to accommodate and press upon a part of the prior bend that extends from a point at or closely adjacent the point of tangency of the as yet unbent tube portion with the bend die.

BRIEF DESCRIPTION OF THE DRAWINGS

FIG. 1 is a perspective view of portions of a bending machine embodying the improved clamp die of the present invention;

FIG. 2 is a perspective view of the clamp die and a portion of the bend die of FIG. 1, showing the bend die insert turned at 90° to better illustrate certain features thereof;

FIG. 13 is a section taken on line 13—13 of FIG. 12, illustrating the rotational and translational displacement of the clamp die;

FIG. 14 is a view similar to FIG. 13 showing the rotational and translational displacement assumed by the clamp die when making a bend upon a tube that has been subsequently bent in a direction opposite to that illustrated in FIG. 13; and FIG. 15 is a view of the bending machine displaced from the starting position of FIG. 12 and in the course of making a bend.

DETAILED DESCRIPTION

Figure 3:
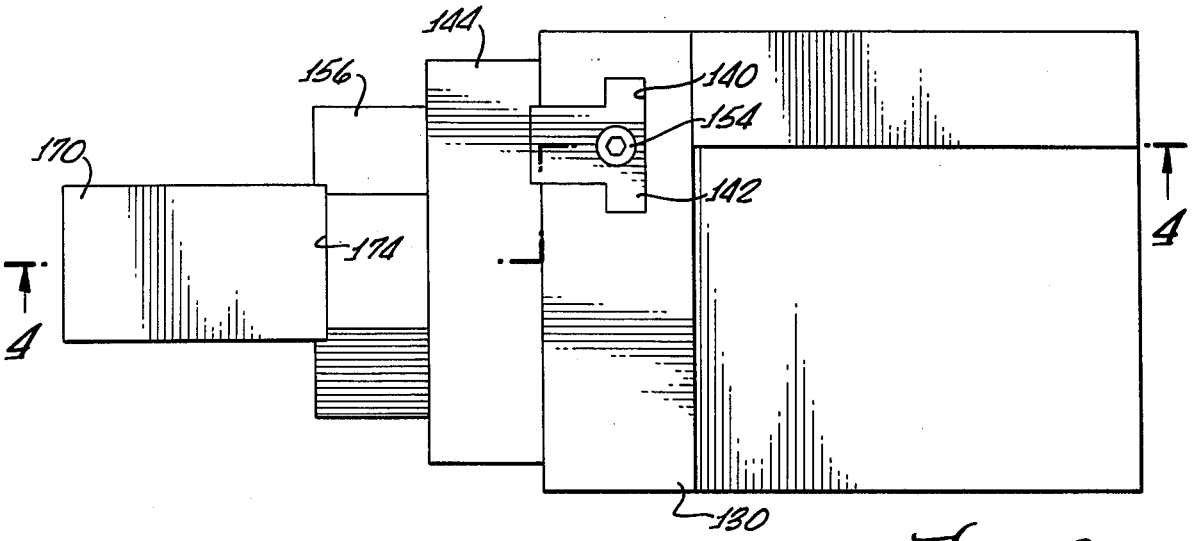
FIG. 3 is a plan view of the floating clamp die.

The bending machine illustrated in part in FIG. 1, is merely exemplary of many different types of bending machines that may employ the floating clamp of the present invention. Such machines include those shown in U.S. Pat. Nos. 3,145,287, 3,145,756, 3,303,683, 2,347,873 and others. It is not necessary, for the use of the floating clamp die described herein, that the machine be capable of performing the combined compression and draw bending operation described in my co-pending applications above identified. Nevertheless, the clamp die described herein, particularly because of its desirably short length, is preferred for use in the combined compression and draw bending methods and apparatus of my co-pending applications.

The bending machine illustrated in FIG. 1 is more fully described in my U.S. patent for Tube Bending Machine and Carriage Therefor, U.S. Pat. No. 3,974,676, and the disclosure of such patent is fully incorporated herein by this reference. This bending machine is adapted for either automatic or manual control and has general functions and operations which are well known, as typically described in U.S. Pat. Nos. 3,821,425, 3,808,856, 3,557,585, 3,426,562, 3,352,136 and 3,156,287, among others. Briefly, the machine comprises a fixedly supported bed having a moving carriage assembly that carries a rotatable chuck. These known features (not shown in FIG. 1) allow the gripping of a tube 16 which is to be advanced and rotated for preselected positioning with respect to the dies carried by a machine bending head generally indicated at 18. The machine includes a wiper or pressure die 22, a bend die 24 rotatable about a vertical axis 23, and a clamp die assembly 26 that is rotatable together with the bend die. Bend die 24 has a replaceable insert 25 at its forward end.

For a bending operation, the carriage (not shown) advances the tube 16 and the chuck (not shown) rotates the tube for positioning with respect to the dies. In general, in this type of machine, the pressure die 22 clamps a rearward portion of the tube 16 against the bend die and the clamp die presses a forward portion of the tube against the bend die (in prior machines). Both the clamp die and bend die are rotated about the axis 23, which is substantially vertical in the illustrated arrangement. This bends the tube about the bend die. Thereafter the dies are retracted, the carriage is advanced and the chuck is rotated to advance the previously made bend beyond the bend die and to properly position the tube both longitudinally and rotatably for the next bend.

The bend head assembly 18 includes a stationary arm assembly 28 in which is mounted the drive mechanism for rotating the bend die. Also mounted on the stationary arm is the mechanism for operating the wiper or pressure die assembly 22. A swinging bend arm assembly 30 is mounted for rotation with the bend die 24 about the axis of the latter and carries the clamp die assembly 26 (to be described below) and its operating mechanism. The clamp die assembly is carried by a clamp die slide 112, that is mounted for power driven reciprocation toward and away from the bend die. Slide 112 carries a clamp die bolster 130 that is fixed to the slide in a selected position of adjustment.

Stationary arm assembly 28 slidably mounts a pressure die bolster 32 which fixedly carries a pressure cylinder 34 having a cylindrical shaft 36 that is connected to and bears against a die adjustment plate 38 that is slidably mounted on the stationary arm by means of a screw 40.

The pressure die bolster 32 slidably mounts a pressure die slide 46 upon which the pressure die itself, designated at 44, is carried. Slide 46 is mounted for motion from right to left, as viewed in FIGS. 1 and 12, in a direction parallel to the axis of the tube 16.

Slide 46 carries a fixed tongue 56 that is connected to be driven by the rod of an hydraulic boost cylinder 60 that is fixedly mounted to and carried by the die bolster 32.

The pressure die 44 can be driven in the direction of the axis of the tube 16 by means of the booster cylinder 60 which drives the pressure die slide 46, and is also slidable with bolster 32 toward the bend die 24 under pressure exerted by pressure cylinder 34.

To exert a variable axial restraint (for combined compression and draw bending), a mechanically adjustable pressure control valve 80 is connected to control exhaust of fluid from the forward end of boost cylinder 60 in accordance with the position of a mechanically operable plunger actuator 82 that forms part of valve 80. As plunger actuator 82 is moved axially inwardly toward the valve body, a greater pressure of fluid within the cylinder is required to exhaust fluid from the cylinder.

Plunger actuator 82 is operated by a cam surface of a cam plate 76 as the latter moves forwardly in the course of a bending operation.

All of the parts described up to this point, except for the clamp die, are the same as those described in my co-pending application, Ser. No. 692,585, and operate in the manner described therein. At the start of a bending operation, the clamp die assembly, is driven toward the bend die to urge the tube 16 firmly against the bend die. Sufficient pressure to hold the tube for draw bending is not exerted upon the forward portion of the tube at this time. The forward portion of the tube will be held on the bend die at least in part by friction after it has been initially bent around the bend die. Pressure die cylinder 34 is operated to drive pressure die 44 toward the bend die and to press the tube between the pressure and bend dies. A constant pressure is exerted upon the pressure die transversely of the axis of the tube, by the pressure die cylinder 34 throughout the entire bending operation.

Boost cylinder 60 is pressurized with an anti-friction bias pressure applied to the end of the cylinder. This pressure remains constant throughout the entire bending operation. As the bend arm assembly begins to rotate, an initial compression bending operation is achieved.

During this initial bending, which continues for approximately the first 15° of a bend, no axial tension is exerted upon the tube and no restraint is exerted by the pressure die upon the tube. To the contrary, in order to overcome friction and to decrease the force required to rotate the bend die, the boost cylinder 60 actually applies a forward driving force to the pressure die which thus exerts a forwardly directed axial compressive force upon the tube 16. This forwardly directed axial force is established at an amount approximately equal to the frictional drag forces of the initial compression bending operation.

After the initial compression bending operation, the pressure die and its cam plate have moved forwardly (in a direction parallel to the tube axis) by an amount that causes the surface of plunger 82 to contact the surface of the cam plate 76. Further bending will cause further forward motion of the cam plate which will move the plunger. Motion of the plunger gradually increases the exhaust pressure of the boost cylinder 60 to a value greater than the anti-friction bias pressure applied thereto. This effects restraint of motion of the pressure die during subsequent rotation of the bend and clamp dies. The axial compression force decreases and an axial tensile force is exerted on the tube to begin a drawing operation. The remainder of the bend continues in this drawing operation, all as described in my co-pending application Ser. No. 692,585.

The above identified co-pending applications describe other methods and apparatus for starting a bend in compression bending (without exerting significant axial restraint upon the tube) and completing the bend in draw bending (exerting sufficient axial restraint to stretch the tube beyond its elastic limit). The floating clamp die described herein may be used with such other methods and apparatus in addition to those specifically described.

Figure 4:
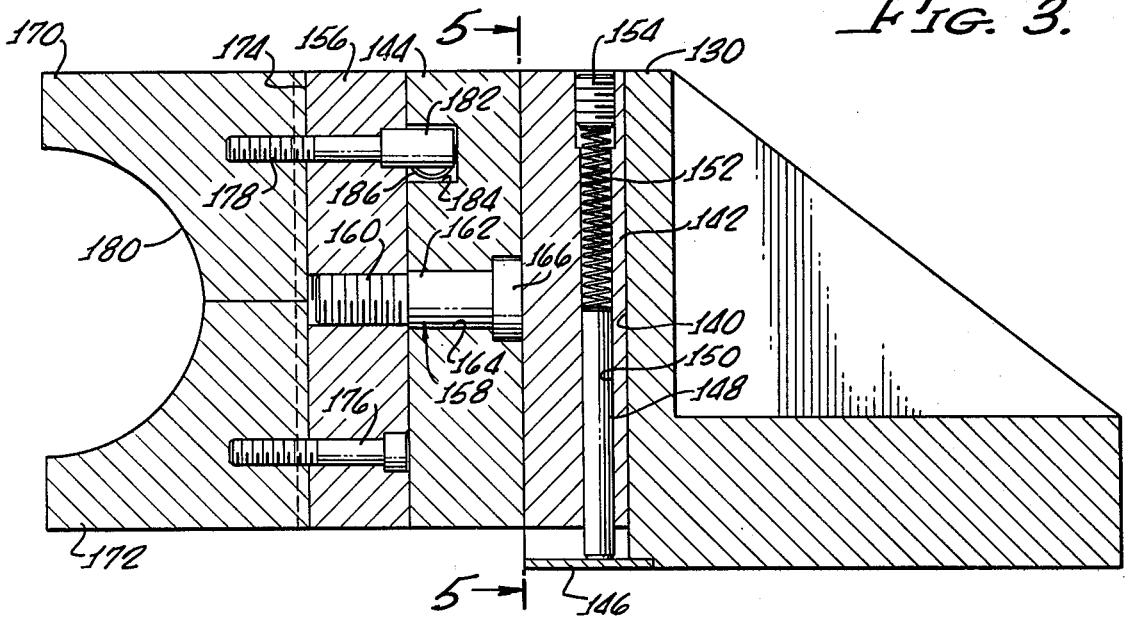
FIG. 4 is a section taken on line 4—4 of FIG. 3.

The improved clamp die assembly of the present invention is movably mounted to clamp die bolster 130. At the start of a bending operation the clamp die cams itself into an adjusted position relative to the bolster as will be more particularly described below. The bolster 130 (FIGS. 2, 3 and 4) is provided with a vertically extending T-shaped slot (guideway) 140 that slidably receives a vertically extending T-shaped guide 142 fixed to a clamp die backplate 144. Bolster 130 and its clamp die mounting guide slot 140 form a part of the machine described in may co-pending applications, above identified. The bolster accepts and mounts the relatively fixed (relative to the bolster) clamp die described in such co-pending applications.

In the clamp die assembly described herein, the guide 142, instead of being aligned with the clamp die to drive the latter in direct opposition to the bend die insert (closely adjacent to the pressure die) is offset toward one side of the clamp die assembly so as to position the clamp die forwardly of the pressure die. In addition to this forward offset of the clamp die, it is mounted for translational and rotational motion relative to the bolster 130, as will be described below.

The bottom of the guideway 140 is closed by a fixed stop plate 146 (FIG. 4) that supports a vertical positioning pin 148 mounted in a vertically extending aperture 150 formed in the guide 142. A translational motion positioning spring 152 is received within the guide hole 150 and retained therein by a screw 154 threaded into and closing the upper end of hole 150.

Backplate 144 is pivoted to a die front plate or pivot member 156 by means of a pivot pin 158 having an end 160 threaded into a threaded aperture of the forward plate 156, a smooth shank 162 rotatably received in a pivot aperture 164 of the backplate, and a head 166 countersunk into the backplate. The clamp die itself is formed of a pair of mutually contiguous clamp die jaws 170, 172 which are received in a slot 174 of the die front plate 156 and fixed to the front plate by means of one or more bolts 176, 178 extending through the front plate into each of the jaws 170, 172. The two jaws collectively define a die cavity 180 that cooperates with similar cavities formed in the bend die and bend die insert to firmly hold the tube. The pressure die also has a similar cavity, as described in detail in my above identified co-pending applications.

Figure 5:
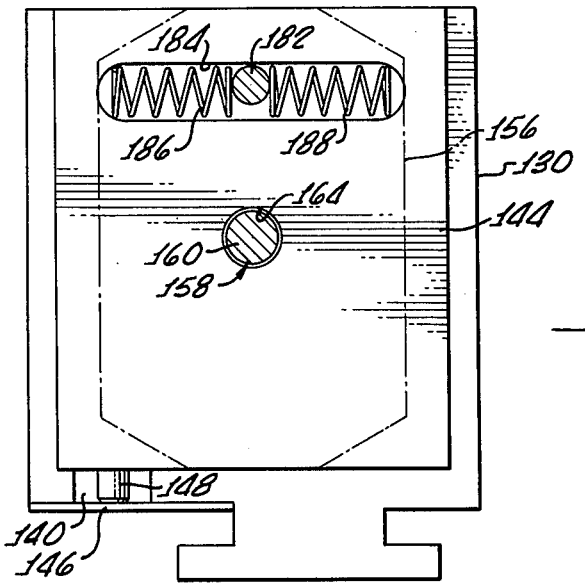
FIG. 5 is a section taken on line 5—5 of FIG. 4.

To limit and center pivotal motion of the die jaws and front plate about the axis of pivot pin 158, a pair of rotational motion centering springs 186, 188 (FIG. 5) are captured within a transverse slot 184 formed in the face of backplate 144. The springs are interposed between the respective ends of the slot and opposite sides of the head 182 of bolt 178 to urge the die jaws and front plate toward a central position if it should pivot in one direction or the other about the pin 158. Slot 184 is made somewhat wider (vertically as viewed in FIGS. 4 and 5) than the diameter of bolt head 182 to permit arcuate motion of the bolt head within the slot.

Thus it will be seen that the two clamp die jaws 170, 172 are mounted to the bolster 130 for limited bi-directional translational motion, from the illustrated normal position, in a direction (up and down as viewed in FIG. 4) generally parallel to the axis of rotation of the bend die. The jaws are also mounted to the bolster for limited rotational motion about an axis angulated to both the axis of the tube 16 and the axis of rotation of the die. The pivot axis of the clamp die is generally normal to both the tube and bend die axes in the exemplary embodiment illustrated herein.

Both rotation and translational motions are of limited extent and a spring return to a normal position is provided for each motion. Should the die be moved downwardly relative to the bolster 130 (as viewed in FIG. 4), spring 152 is compressed and tends to return the die to its illustrated position. Should the die be moved upwardly, the weight of the die and of the front and back plates thereof tends to return it to the illustrated position. The die jaws are linearly or rotationally (or both) cammed from the illustrated normal position thereof as the clamp die assembly is driven toward engagement with a previously bent portion of the tube, for making bends that are close to previous bends, as will be described below.

Although vertical orientation of the bi-directional translational motion of the clamp die is preferred for use with the described bending machine, other orientations may be employed, particularly where the bend die axis is not generally vertical. So too, other orientations of the pivot pin axis or other die motions or combinations of motions may be employed to enable the clamp die jaws to accommodate an angulated portion of the tube.

As can be seen in FIG. 2, bend die insert 25 has its tube receiving cavity modified to enable a second bend to be made closely adjacent the first bend. Thus the cavity has a bell shape, flaring outwardly and forwardly from its rearward side 190 (adjacent the main body of the bend die) to the forward side 192 of the insert. The flared die jaw surfaces are indicated at 191, 193.

Figure 6:
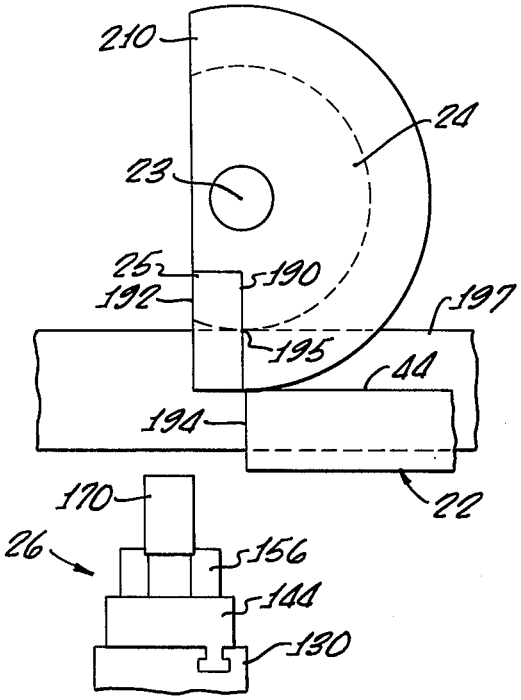
FIG. 6 is a plan view schematically illustrating the relation of the several dies prior to the start of a bending operation.
Figure 7:
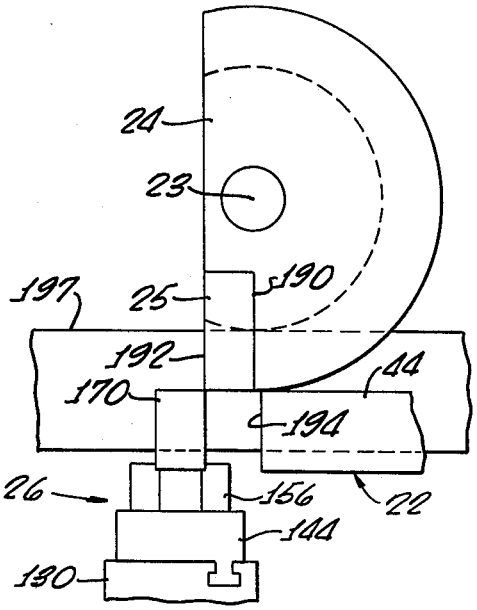
FIG. 7 is a view similar to FIG. 6, showing the clamp die in position upon a straight portion of a tube.

In order to accommodate pivotal motion of the clamp die and avoid interference between the latter and the pressure die, the clamp die is positioned forwardly of the forward end of the pressure die by a distance that is at least a significant fraction of the length of the clamp die. This arrangement is best shown in FIGS. 6 and 7. FIG. 6 shows the machine with the pressure die in engagement with a tube 197 and the clamp die retracted. FIG. 7 shows the clamp die in position, pressing against the tube 197, which has not yet been bent. Bend die 24 is a circular segment, extending slightly more than 180° about its axis 23. Insert 25 has its rear face 190 lying on a diameter of the bend die, which diameter intersects the point of tangency 195 of the tube 197. Pressure die 44 has its forward end 194 positioned substantially at or just slightly to the rear of the point of tangency. In prior bending machines of this type, the clamp die is positioned for motion toward and away from the bend die in a direction substantially parallel to the diameter of the bend die that intersects tangent point 195. The rear face of the prior art clamp die is closely adjacent the forward face 194 of the pressure die, when the parts are in position to begin a bend. Thus the prior art clamp die is directly opposed to the bend die insert and, when the clamp die is forced toward the bend die, the tube to be bent is directly clamped between the clamp die and the bend die.

In the present arrangement on the other hand, the clamp die is offset forwardly (in the direction of the axis of the tube to be bent) from the bend die diameter that intersects the tangent point. This is illustrated in FIG. 6, showing the clamp die and its bolster in retracted position prior to making of a bend. The clamp die and bolster are driven forwardly at the start of a bend from the position of FIG. 6 to assume the position illustrated in FIG. 7 with the clamp die remaining in its normal position. For this illustration of clamp position it is assumed that the tube had not been previously bent, or the next bend is separated from a prior bend by a straight tube portion longer than the length of the clamp die. As shown in FIG. 7, the clamp is pressing against a forward portion of the tube that extends forwardly of the forward side of the insert 25. FIG. 7 shows the forward offset of the clamp die relative to the forward end of the pressure die 44. This allows the clamp die jaws 170, 172 to pivot about an axis parallel to the diameter of the bend die that intersects the tangent point, if such pivotal motion is required.

In an exemplary embodiment, bend die insert 25 has a length (along the tube axis) of about one inch and the clamp die jaws also are about 1 inch in length. Thus the clamp die is not directly opposed to the bend die insert. Instead, the tube is contacted at three axially spaced points by the clamp, bend and pressure dies.

Figures 8, 12:
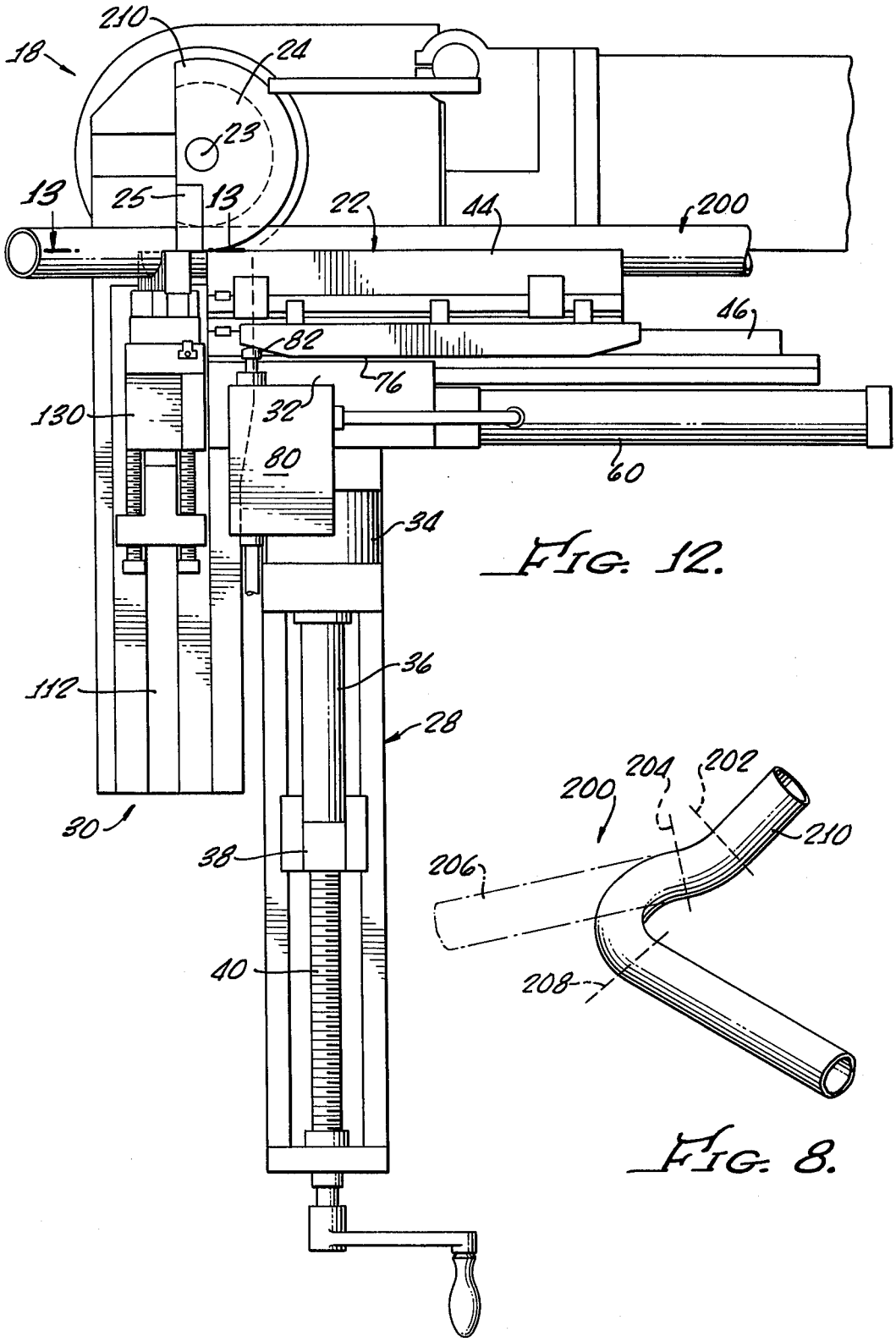
FIG. 8 is a perspective view of a segment of a tube having two closely adjacent bends, showing in dotted lines the tube configuration before making the second bend.
FIG. 12 is a plan view of the machine of FIG. 1 showing the relation of parts prior to making a bend that is to start closely adjacent a prior bend, and illustrating displacement of the clamp die.

The illustrations of FIGS. 6 and 7 are presented in order to better show the relative position of the clamp die, in its normal position, with respect to the bend and pressure dies. However, the movably mounted clamp die described herein facilitates bending of a tube at a point that is at or closely adjacent the tangent point of a prior bend. Thus it is possible to bend a pipe in the manner illustrated in FIG. 8. Assume that a prior bend has been made in tube 200 of FIG. 8 between a forward tangent plane (a plane normal to a tangent to the bend) 202 and a rear tangent plane 204 and that the rear portion of the tube extends as shown in dotted lines and indicated at 206. Employing the described floating clamp, a second bend may be made in this pipe having a forward tangent plane substantially at rear tangent plane 204 of the prior bend and having a rear tangent plane 208. Only for purposes of exposition the second bend is shown as having a plane of bend at 90° to the plane of the first bend. Obviously other angles between planes of adjacent bends may be obtained. Consider the pipe 200 to have had its first bend previously made between planes 202 and 204. The pipe is positioned in the bending machine as shown in FIG. 12. Rearward tangent plane of the bend already made, plane 204, is positioned on the bend die diameter that runs along the rear face of insert 25. Forward tangent plane 202 of the prior bend is positioned forwardly of the pressure die and also may be forward of the bend die. The forward portion 210 of the tube now extends upwardly at an angle to the extent of the rear (and still straight) portion 206 of tube that is still resting on the machine bed. This relation of parts is also illustrated in FIG. 13, which comprises a sectional view looking into the cavity of the clamp die but with the bend die shown in dotted lines. The tube 200 is placed in the illustrated position and the prior bend, between planes 202 and 204, extends through the divergent surfaces 191, 193 of the bend die insert 25. These divergent surfaces allow the previously bend portion of the tube to be received in the bend die insert cavity. Thus the rear edge of the bend die insert can be positioned substantially at the rear tangent plane of the prior bend whereby the next bend can be started substantially at prior bend.

Figure 9A:
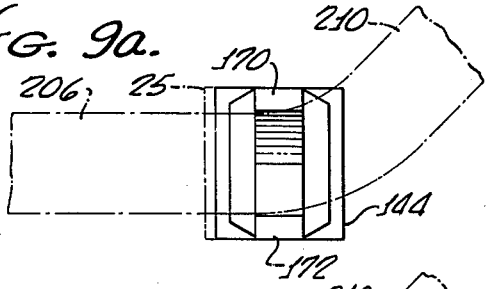
FIGS. 9*a*, 9*b*, 10*a*, 10*b* and 11*a*, 11*b* are schematic side and front illustrates showing the relation of the movable clamp die to its support and to the tube as the die is driven toward the tube at the start of a bending operation.
Figure 9B:
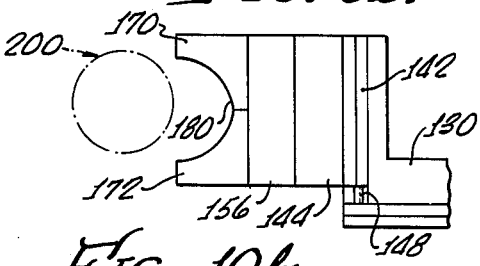
Figure 10A:
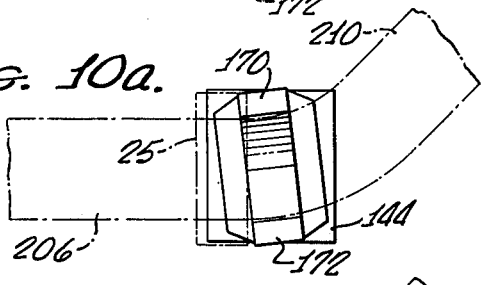
Figure 10B:
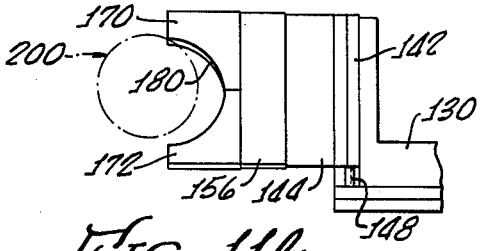
Figure 11A:
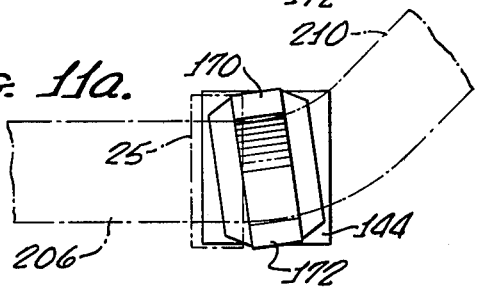
Figure 11B:
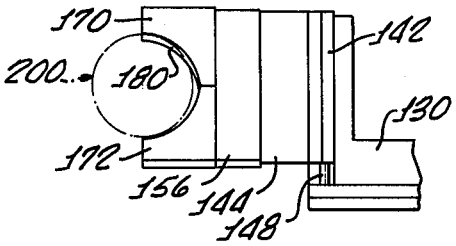

FIGS. 9*a*, 9*b*, 10*a*, 10*b*, and 11*a*, 11*b* are pairs of respective front and side views showing the relation of the clamp die to a previously bent tube as the clamp die moves from a retracted position toward the bend die into engagement with the tube, at a point close to the prior bend, prior to the start of a bending operation. FIGS. 9*a* 9*b* show the parts before any engagement of the clamp die with the tube. The forward portion 210 of the tube extends upwardly via the previous bend from the rear and as yet unbent portion 206 of the tube. The clamp is positioned in a neutral non-rotated and non-displaced position with respect to the clamp carrying bolster 130. As the bolster is driven laterally toward the bend die, the clamp initially contacts the tube (FIGS. 10*a*, 10*b*) with the upper clamp jaw 170 engaging an upper surface of the tube and the lower jaw 172 being out of engagement with the tube. Thus, there is no registry of the clamp cavity with the upwardly extending front portion 210 of the tube at this point. Without the movable mounting of the clamp die, its cavity could not properly engage the upwardly extending or bent portion of the tube. Without such movable mounting of the clamp die, the straight section 206 of the pipe would have to be moved forwardly until a sufficient length of such straight section was provided for grasping by the clamp die. Thus without such movable mounting of the clamp die, the subsequent bend would necessarily be displaced from a prior bend by at least the length of the clamp die.

The flared bend die insert also enables this positioning of the tube with its prior bend partly in the bend die cavity. It may be noted that the movable mounting of the clamp die is preferred to a similar flared cavity of a fixed clamp die because the latter would afford an undesirably small area of contact of the clamp die with the tube. The bend die, on the other hand, increases its tube contact area as soon as bending commences.

As the bolster and clamp die move to the final position of the clamp die (FIGS. 11*a*, 11*b*), the latter is still further cammed by its engagement with the tube. The die is further displaced upwardly via its guide and guideway and is further rotated until the cammed clamp die cavity properly and fully seats itself upon the bent section of tube.

FIG. 14 is a view similar to FIG. 13, but showing the position assumed by the clamp die as it is advanced upon a tube that has been turned 180° relative to the tube of FIG. 13 to make the next bend with a different plane of bend. Thus, the clamp die mounting permits the die to be cammed into various diverse positions as required by the previous bend and the bend that is about to be made.

The second bend is commenced with the machine in the position illustrated in FIGS. 12 and 13. The swingable arm assembly, including the bend die and the clamp die assembly, moves through the position illustrated in FIG. 15 to completion of the second bend, which is illustrated in FIG. 8.

There is little or no direct opposition of the bend die and the clamp die since the latter is displaced forwardly of the former. In effect a three-point bending is achieved with the bend die pressing the tube in one direction at a point between two laterally displaced points at which the pressure and clamp dies urge the tube in an opposite direction.

After the clamp and pressure dies are positioned, as shown in FIG. 12, to urge the tube toward the bend die, bending is achieved in the same manner as described in my above identified patent applications. Bending is commenced as a compression bending with no axial restraint exerted upon the tube for an initial portion of the bend, in the order of 15°, for example. During this portion of the bend, the tube is partly bent around the bend die and, as bending continues, exhaust pressure of boost cylinder 60 is increased by operation of plunger 82 of the boost cylinder valve 80. This increasing axial restraint places sufficient tension on the tube to provide a draw bending action in which the tube is stretched and the bending is completed in this draw bending mode.

Operation of the floating clamp die has been described for making of a second bend closely adjacent to and in a plane at 90° to the plane of a previous bend, for simplicity of illustration. However, it will be readily appreciated that the described apparatus is useful in making such closely adjacent bends with any of a large number of angular relations between the plane of bend of the two successive bends.

It is not necessary that the bend die be modified (as by flaring its insert) in order to practice the present invention. If only the clamp die is modified, mounting it for motion to accommodate the prior bend as previously described, and if the bend die is not modified, the subsequent bend must be displaced from the prior bend by an amount approximately equivalent to the required clearance distance between the clamp die and the pressure die, and the bend die insert 25 would have a commensurate length. This is a considerable improvement. However, two successive bends can be positioned even closer to each other by modifying the bend die to accommodate the rearward portion of a prior bend such as the portion extending forwardly from tangent plane 204 of FIG. 8, for example. This modification has been described and illustrated in FIGS. 2, 14 and 15, as comprising a forwardly and outwardly diverging surface of the cavity of the bend die insert. Alternatively the bend die, which is of a circular configuration at a portion 210 thereof diametrically opposed to the portion at which the insert 25 is located, may be turned over so that such portion 210 is positioned between the pressure and clamp dies. Thus the cavity of the inverted bend die just forwardly of the tangency of the unbent tube therewith, would diverge forwardly and outwardly of the tube centerline and provide accommodation for reception of a prior bend closely adjacent to a point at which the subsequent bend is to be commenced.

There has been described a bending machine having an improved clamp die that is movably mounted for self-adjustment to accommodate tube portions that extend angularly relative to tube portions that are yet to be bent, whereby successive bends may be closely adjacent to one another.

The foregoing detailed description is to be clearly understood as given by way of illustration and example only, the spirit and scope of this invention being limited solely by the appended claims.

I claim:

1. A bending machine having a bend die rotatable about a bend axis and a pressure die, said bend die having a tube receiving cavity diverging forwardly and outwardly of a tube received therein, and a floating clamp die assembly, said assembly comprising a retractable bolster movable toward said bend die and having a guideway therein extending in a first direction normal to the axis of the tube to be bent and substantially parallel to said bend axis, a clamp mounting member having a guide slidably received in said guideway, spring means for urging said guide to a preselected position relative to said guideway, a clamp die, and means for mounting said clamp die to said clamp mounting member for pivotal motion about an axis normal to said bend axis and normal to said tube axis, whereby as said bolster is moved toward said bend die said clamp die may be adjustably positioned by a tube to be bent and will press such tube into said diverging tube cavity of the bend die.

2. The machine of claim 1 wherein said guideway extends in a vertical direction, and wherein said spring means comprises a pin mounted in said guideway, a spring retainer mounted to said guide, and a spring interposed between said pin and retainer, whereby said die and mounting member are spring urged upwardly and gravity urged downwardly if displaced downwardly or upwardly from a reference position.

3. The machine of claim 1 including spring means for urging said pivot member in one direction or another to a normal position.

4. The machine of claim 1 including means for limiting said pivotal motion of said clamp die comprising a slot in one of said clamp die and clamp mounting member, a pin fixed to the other extending into said slot, and spring means for centering said pin in said slot.

5. In a tube bending machine having a bend die rotatable about a bend axis, a pressure die for urging a rearward portion of a tube toward the bend die, and a retractable clamp bolster adapted to be moved toward said bend die and carrying a clamp die for urging a forward portion of the tube toward the bend die, said dies having tube receiving cavities therein, the improvement comprising means for movably mounting said clamp die to said bolster for receiving within its cavity portions of different tubes extending forwardly of the bend die at various angles with respect to the longitudinal extent of the tube to be bent, said clamp die mounting means comprising, a clamp die mounting member supported on said bolster for slidable motion substantially parallel to the axis of said bend die, means for mounting said clamp die to said mounting member for pivotal motion about an axis normal to said bend axis and to the axis of the tube to be bent, said bend die cavity diverging forwardly and outwardly of a tube to be received therein, whereby a tube portion extending from the bend die at an angle to the plane of a bend to be made may be received within the diverging bend die cavity portion and whereby as the retractable bolster is moved toward the bend die, the clamp die may contact the tube to be bent to be pivoted thereby relative to said clamp die mounting member and shifted thereby parallel to the axis of said bend die so that the bend die and clamp die cavities will seat upon the angled forwardly extending portion of said tube to be bent.

* * * * *

UNITED STATES PATENT AND TRADEMARK OFFICE

CERTIFICATE OF CORRECTION

PATENT NO. : 4,078,411

DATED : March 14, 1978

INVENTOR(S) : Homer L. Eaton

It is certified that error appears in the above-identified patent and that said Letters Patent are hereby corrected as shown below:

Col. 8, line 12: Change "bend" to ---bent---;

Col. 8, line 16: After "at" and before "prior", insert ---the---;

Col. 8, line 23: After "9a" and before "9b", insert ---and---;

Col. 10, line 42: After "other" and before "extending", insert ---and---.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*